United States Patent [19]

Apple, Sr.

[11] 4,209,198

[45] Jun. 24, 1980

[54] KNOCKDOWN CHAIR

[75] Inventor: Charles N. Apple, Sr., Greensboro, N.C.

[73] Assignee: Metafab Industries, Inc., Greensboro, N.C.

[21] Appl. No.: 942,744

[22] Filed: Sep. 15, 1978

[51] Int. Cl.[2] ..... A47C 7/00

[52] U.S. Cl. ..... 297/443; 297/440; 297/441; 297/445

[58] Field of Search ..... 297/440, 441, 443–445

[56] References Cited

U.S. PATENT DOCUMENTS

| | | | |
|---|---|---|---|
| 3,526,433 | 9/1970 | Miller | 297/440 |
| 3,674,311 | 7/1972 | Miller | 297/440 |
| 3,774,966 | 11/1973 | Faulkner et al. | 297/440 |
| 3,972,559 | 8/1976 | Anacker | 297/441 X |
| 3,973,800 | 8/1976 | Kogan | 297/440 |

*Primary Examiner*—James C. Mitchell

[57] ABSTRACT

The device contained herein comprises a knock-down chain which has a flexible sling for a back cushion support. The ease of assembly of the chair provides an advantage to the user in that it can be stored in disassembled fashion and as needed can be reassembled rapidly by unskilled persons without the use of tools.

8 Claims, 4 Drawing Figures

KNOCKDOWN CHAIR

BACKGROUND AND OBJECTIVES OF THE INVENTION

Furniture which can be assembled for use and disassembled for packaging or shipping purposes is old and well known in the furniture trade. Generally, furniture of this type which is referred to as "knock-down" furniture is of a lower quality or, as referred to in the furniture trade, "second line" merchandise and is not among the top quality line. Also, knock-down furniture as the term is conventionally used, depicts furniture that can be disassembled for shipment, yet the assembly of it requires a person of at least semi-skills because hand tools such as a hammer and screwdriver are generally required to erect the furniture piece in order to put it in use.

With this background in mind the present invention was conceived and one of its objectives is to provide a knock-down furniture item which is of top quality or "first line" stature;

It is another objective of the present invention to provide a knock-down chair which can be easily assembled and disassembled without the use of tools;

It is yet another objective of the present invention to provide a knock-down chair which is relatively inexpensive to manufacture and can be assembled by unskilled personnel;

It is still another objective of the present invention to provide a knock-down chair which is pleasing in appearance and comfortable for the user.

Other objectives and advantages of the present invention will become apparent to those skilled in the art in light of the following specifications.

SUMMARY OF THE INVENTION AND DESCRIPTION OF THE DRAWINGS

The present invention consists of a chair (chair as used herein refers to a furniture item used for sitting, by one or more persons depending upon the desired requirements) which may be shipped in disassembled form to reduce its bulk, and upon delivery, for example to the owner's home, may be unpackaged and completely assembled in a few minutes by unskilled personnel without the use of hand or other tools. The chair is assembled by joining the back cushion support or sling means to the back member by looping it over the upper horizontal portion of the back member. The lower portion of the sling means is then affixed to the seat frame. Next, the seat frame is joined to the front vertical sections of the side members and then the side members' rear appendages are inserted into the slots provided in the vertical portions of the back member. Thereafter, the terminal ends of the lateral braces are slid into the brace slots provided in the vertical portions of the back member whereby the chair frame is then rigidly assembled. Finally, back and seat cushions are placed on the frame and the chair is then ready for use. Double seated chairs, sofas, or other designs may be developed utilizing the principles referred to above.

Turning now to the drawings.

Figure 1:
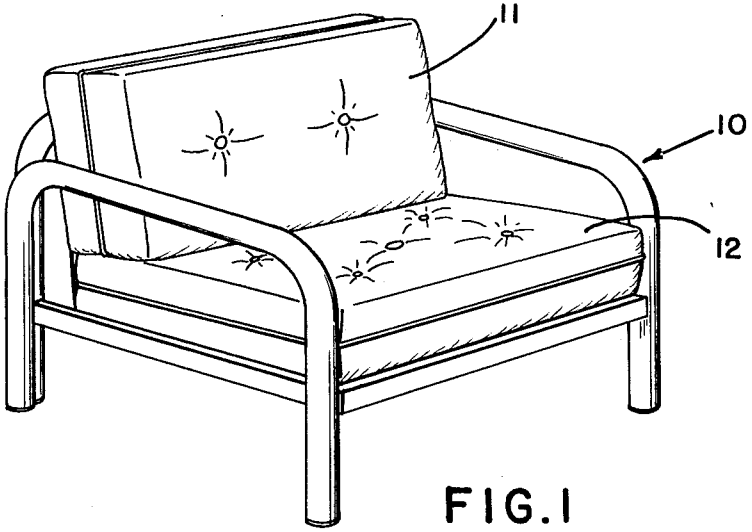
FIG. 1 illustrates the assembled form of the preferred embodiment of the present invention.

For a more detailed description of the drawings, FIG. 1 demonstrates the preferred embodiment of the chair 10 in assembled form including back cushion 11 and seat cushion 12 in place and ready for use.

Figure 2:
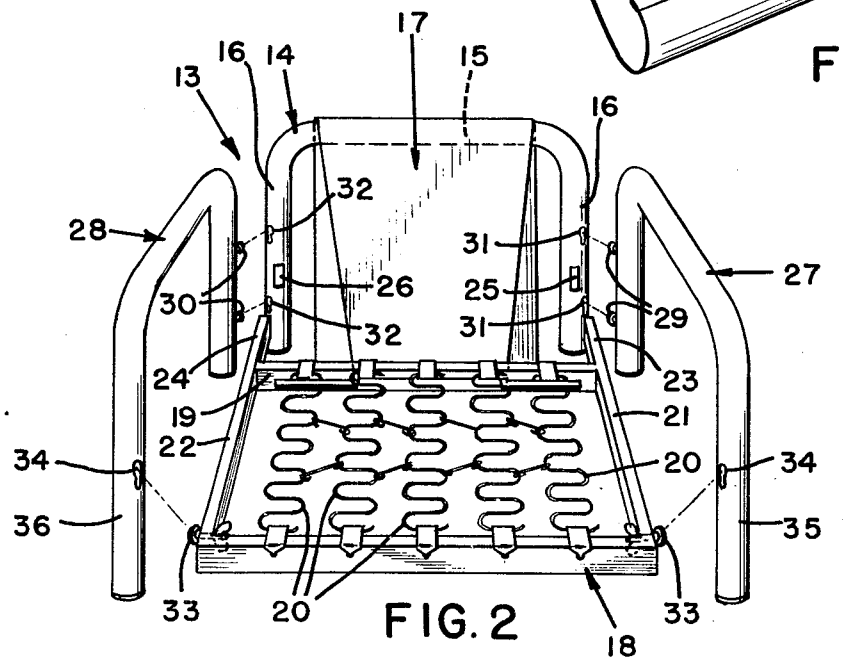
FIG. 2 shows the frame of the chair as shown in FIG. 1 in generally disassembled form.

FIG. 2 demonstrates the exploded frame 13 which includes back member 14 having upper horizontal portion 15 and vertical portion 16. As shown, sling means or back cushion support 17 wraps around upper horizontal portion 15 of back member 14 and joins seat frame 18 along the inside of rear brace member 19 of seat frame 18. Shown also on seat frame 18 are sinuous springs 20 which add to the comfort of the assembled chair. Lateral braces 21 and 22 have extending terminal ends 23 and 24 respectively which are inserted into brace slots 25 and 26 of back member 14.

Also shown in FIG. 2 are side members 27 and 28 which include rear appendages 29 and 30, respectively, for insertion into the appendage slots 31 and 32 on back member 14.

FIG. 2 demonstrates the first step in the assembly of the preferred embodiment of the invention with sling means 17 being rotatably attached to back member 14 and being affixed to seat frame 18. Seat frame 18 can then attach to side members 27 and 28 by slipping appendages 33 into the appendage openings 34 provided on the front vertical section 35 and 36 of side members 27 and 28, respectively. With the front appendages 33 of seat member 14 thus positioned in appendage openings 34 of side members 27 and 28, rear through appendages 29 and 30 can be inserted into the corresponding appendage slots 31 and 32 of back member 14 while simultaneously inserting the terminal ends 23 and 24 into brace slot openings 25 and 26.

With the chair frame 13 thus assembled, the chair would be then ready for use with the addition of back and seat cushions 11 and 12 (not shown in FIG. 2).

Figure 3:
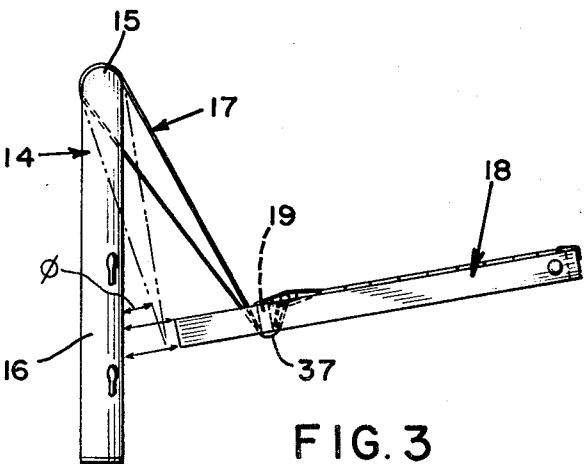
FIG. 3 illustrates the back cushion support means positioned on the back member and joined to the seat frame prior to the terminal ends of the lateral brace of the seat frame slidably engaging with the back member.

In FIG. 3, back member 14 is shown with sling means 17 rotatably connected to its horizontal portion 15. Sling means 17 is looped over horizontal portion 15 or rotatably connected thereto and is rigidly affixed to seat frame 18. As shown, sliding means 17 has a lower terminal portion 37 which passes under the rear brace member 19 for affixation to seat frame 18. FIG. 3 demonstrates the rotatable feature of sling means 17 and the approximate angular placement of sling means 17 with the vertical portion 16 of back member 14. The angle phi ($\phi$) between back member 14 and sling means 17 allows the back cushion to slant from top to bottom in a rearward fashion away from the seat cushion (not shown in FIG. 3) to provide additional comfort to the user. The chair has been found to exhibit comfortable properties when the $\phi$ angle is between 20°–50° but other angular displacements may be useful depending upon the individual requirements.

Figure 4:
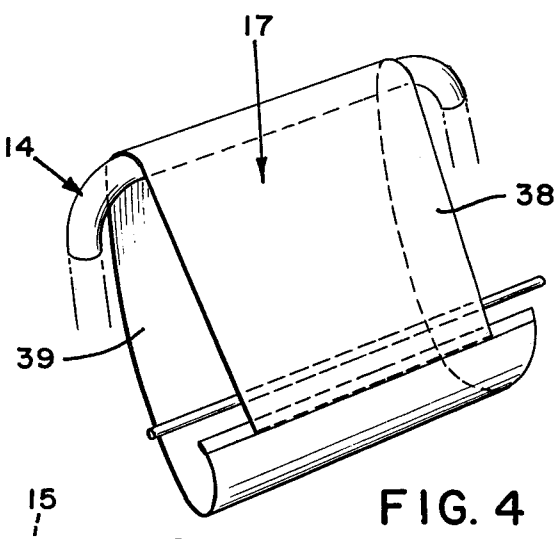
FIG. 4 illustrates the flexible sling being "looped-over" or rotatably joined to a fragmented back member.

FIG. 4 shows sling means 17 attached to back member 14 (shown in fragmented fashion in this view) and having a narrower width front portion 38 and a wider rear portion 39, though other designs of the sling means 17 may be equally useful.

The examples and illustrations as shown herein are not for the purposes of limiting the invention.

I claim:

1. A knockdown chair comprising: side members, a back member, said side members slidably engagable with said back member, a seat frame, said seat frame slidably engagable with said side and back members, a flexible back cushion support means, said back cushion support means being rotatably joined to said back member and joined to said seat frame whereby said support means aligns said seat frame for engagement of said seat frame with said back member.

2. A knockdown chair as claimed in claim 1, wherein said side members are of an inverted U-shaped configuration.

3. A knockdown chair as claimed in claim 1, wherein said back member has an inverted U-shaped configuration.

4. A knockdown chair as claimed in claim 1, wherein said seat frame includes a plurality of sinuous springs.

5. A knockdown chair as claimed in claim 1, wherein said back cushion support means comprises a sling means.

6. A knockdown chair as claimed in claim 5 wherein said back cushion support means is positioned angularly to said seat frame.

7. A knockdown chair comprising: inverted u-shaped side members, an inverted u-shaped back member, said side members having appendages which are slidably received by said back member, a seat frame, said seat frame including sinuous spring members, said seat frame being removably attached to said back member and said side members, a flexible back cushion support means, said support means being rotatably attached to said back member and removably attached to said seat frame whereby said support means aligns said seat frame for attachment of said seat frame with said back member.

8. A knockdown chair as claimed in claim 1 and including removable seat and back cushions.

* * * * *